US010750289B2

(12) United States Patent
Zhang

(10) Patent No.: US 10,750,289 B2
(45) Date of Patent: Aug. 18, 2020

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,064

(22) Filed: Jul. 28, 2019

(65) Prior Publication Data

US 2020/0045447 A1 Feb. 6, 2020

(30) Foreign Application Priority Data

Aug. 5, 2018 (CN) ..... 2018 1 252656

(51) Int. Cl.

| | |
|---|---|
| ***H04R 9/04*** | (2006.01) |
| ***H04R 9/06*** | (2006.01) |
| ***H04R 7/16*** | (2006.01) |
| ***H04R 9/02*** | (2006.01) |

(52) U.S. Cl.

CPC ..... *H04R 9/045* (2013.01); *H04R 7/16* (2013.01); *H04R 9/025* (2013.01); *H04R 9/06* (2013.01); *H04R 2400/11* (2013.01); *H04R 2499/11* (2013.01)

(58) Field of Classification Search

CPC ..... H04R 2400/03; H04R 2400/07; H04R 11/02; H04R 11/06; H04R 9/066

USPC ..... 381/398, 396, 152

See application file for complete search history.

(56) References Cited

U.S. PATENT DOCUMENTS

| | | | | |
|---|---|---|---|---|
| 2006/0110003 | A1* | 5/2006 | Lin | H04R 9/045 381/400 |
| 2011/0051987 | A1* | 3/2011 | Ueda | H04R 9/06 381/412 |
| 2012/0106775 | A1* | 5/2012 | Shao | H04R 9/043 381/412 |
| 2014/0185839 | A1* | 7/2014 | Hashimoto | H04R 9/025 381/162 |
| 2014/0241566 | A1* | 8/2014 | Choi | H04R 9/043 381/400 |
| 2014/0321691 | A1* | 10/2014 | Kim | H04R 1/06 381/398 |
| 2015/0341728 | A1* | 11/2015 | Pan | H04R 9/045 381/412 |
| 2017/0353800 | A1* | 12/2017 | Lee | H04R 7/12 |

* cited by examiner

*Primary Examiner* — Fan S Tsang
*Assistant Examiner* — Julie X Dang
(74) *Attorney, Agent, or Firm* — W&G Law Group LLP

(57) ABSTRACT

The present disclosure provides a speaker, including a holder, a vibration unit, a magnetic circuit unit, and an electrical connection member. The vibration unit includes a diaphragm and a voice coil located at one side of the diaphragm and driving the diaphragm to vibrate and emit sound. The electrical connection member is electrically connected to the voice coil and elastically supporting the voice coil. The electrical connection member includes a support portion supporting an end of the voice coil facing away from the diaphragm, an elastic arm arranged spaced apart from the support portion, and opposite ends of the elastic arm along a side of the voice coil respectively a joint extending from the support portion. The voice coil is sandwiched and fixed between the first extension arm and the second extension arm.

13 Claims, 6 Drawing Sheets

A–A

SPEAKER

TECHNICAL FIELD

The present disclosure relates to the field of acoustic-electrical conversion, and in particular, to a speaker used in portable electronic products.

BACKGROUND

With the advent of the mobile Internet era, the number of smart mobile devices continues to rise. Among the numerous mobile devices, mobile phones are undoubtedly the most common and portable mobile terminal devices. At present, functions of the mobile phones are extremely diverse, one of which is high-quality music. Therefore, speakers for playing sound are widely used in today's smart mobile devices.

A speaker in the related art includes a holder, a magnetic circuit unit received in the holder, a vibration unit received in the holder, and an electrical connection member received in the holder and electrically connected to the vibration unit. The magnetic circuit unit is used to drive the vibration unit to vibrate and emit sound. The magnetic circuit unit includes a magnetic frame and a magnet assembled on the magnetic frame and forming a magnetic gap with the magnetic frame. The vibration unit includes a diaphragm used to vibrate and emit sound, and a voice coil having one end connected to the diaphragm and another end inserted into the magnetic gap. By applying a current to the voice coil through an external circuit of the electrical connection member, the voice coil vibrates by being subjected to the Lorentz force in the magnetic field, and drives the diaphragm to vibrate and emit sound.

However, in the related art, generally only one surface between the electrical connection member and the voice coil of the speaker is bonded, such that the bonding strength is insufficient, which makes it easy for detachment to occur between the electrical connection member and the voice coil when the voice coil severely vibrates, thereby affecting the acoustic performance of the speaker.

Therefore, it is necessary to provide a new speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
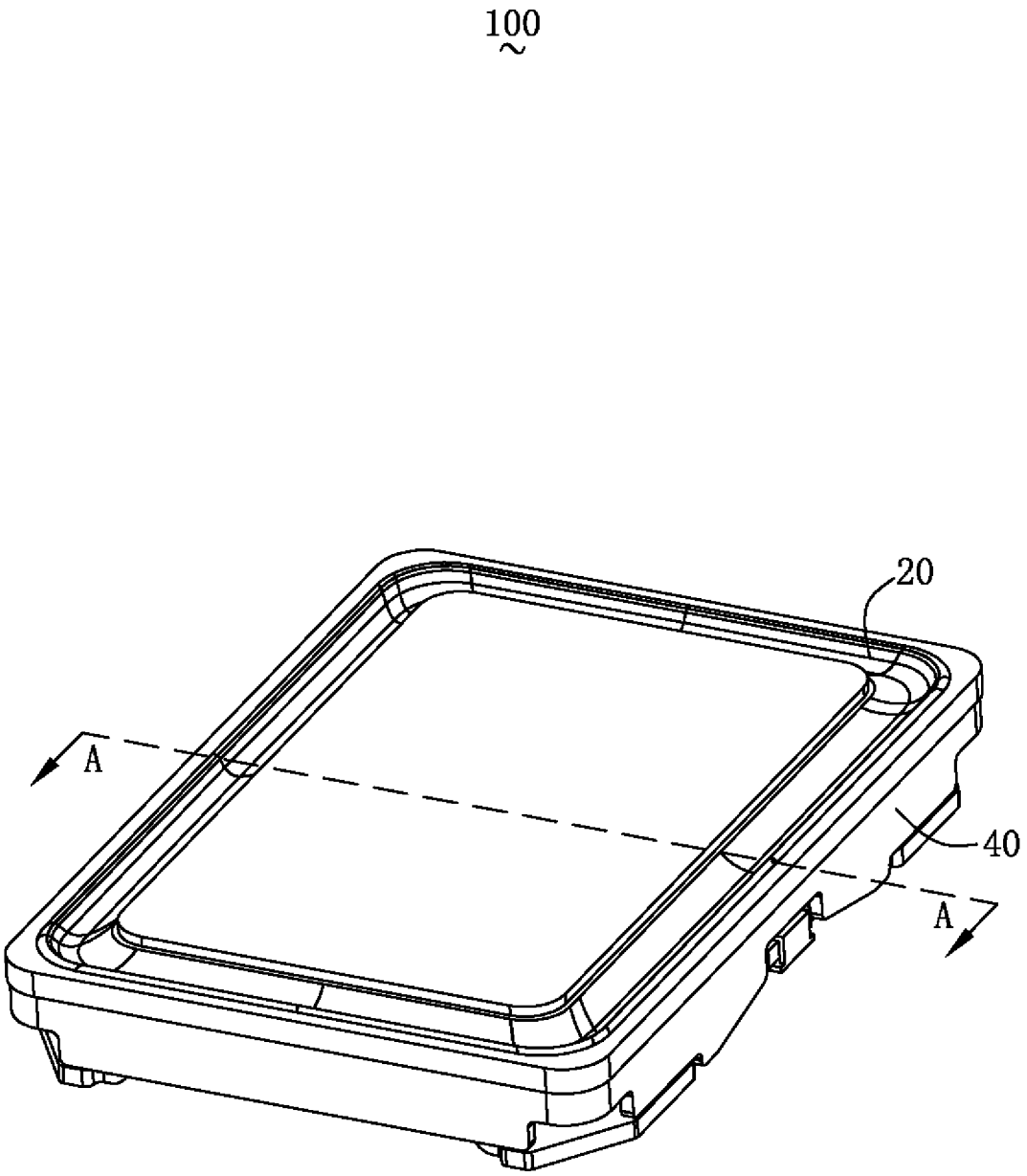
FIG. 1 is a perspective structural schematic diagram of a speaker of the present disclosure.
Figure 2:
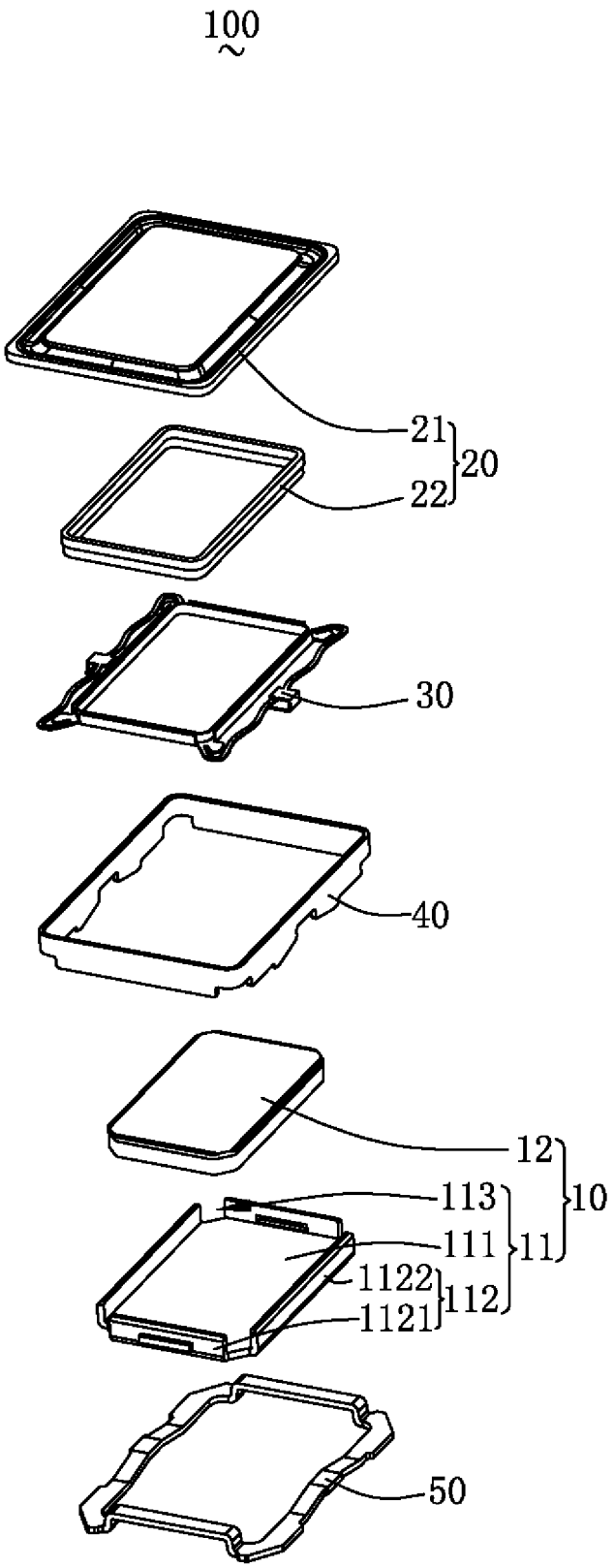
FIG. 2 is an exploded structural schematic diagram of a speaker of the present disclosure.

Referring to FIG. 1 and FIG. 2, the present disclosure provides a speaker 100. The speaker 100 includes a magnetic circuit unit 10, a vibration unit 20, an electrical connection member 30 connected to the vibration unit 20, a holder 40 having a receiving space for receiving the magnetic circuit unit 10, the vibration unit 20 and the electrical connection member 30, and a frame body 50 fixedly provided at an end of the holder 40 close to the electrical connection member 30. The magnetic circuit unit 10 is used to drive the vibration unit 20 to vibrate and emit sound.

The magnetic circuit unit 10 includes a magnetic frame 11 connected to the holder 40 and a magnet 12 received in the magnetic frame 11.

The magnetic frame 11 includes a bottom wall 111 connected to the magnet 12, a sidewall 112 extending from the bottom wall 111 while being bent towards the vibration unit 20, and an avoiding portion 113 penetrating through the sidewall 112.

The sidewall 112 includes a pair of first sidewalls 1121 arranged opposite to each other and a pair of second sidewalls 1122 arranged opposite to each other. There are four avoiding portions 113, and the four avoiding portions 113 are respectively located at a position where a first sidewall 1121 and a second sidewall 1122 that are adjacent are connected. The two first sidewalls 1121, the two second sidewalls 1122 and the four avoiding portions 113 together enclose a rectangular ring structure, i.e., a direction in which the first sidewall 1121 is arranged and a direction in which the second sidewall 1122 is arranged are perpendicular to each other.

The magnet 12 is arranged spaced apart from the sidewall 112 to form a magnetic gap.

The vibration unit 20 includes a diaphragm 21 used to vibrate and emit sound and a voice coil 22 located at a side of the diaphragm 21 and used for driving the diaphragm 21 to vibrate. The voice coil 22 is inserted into the magnetic gap.

Figure 3:
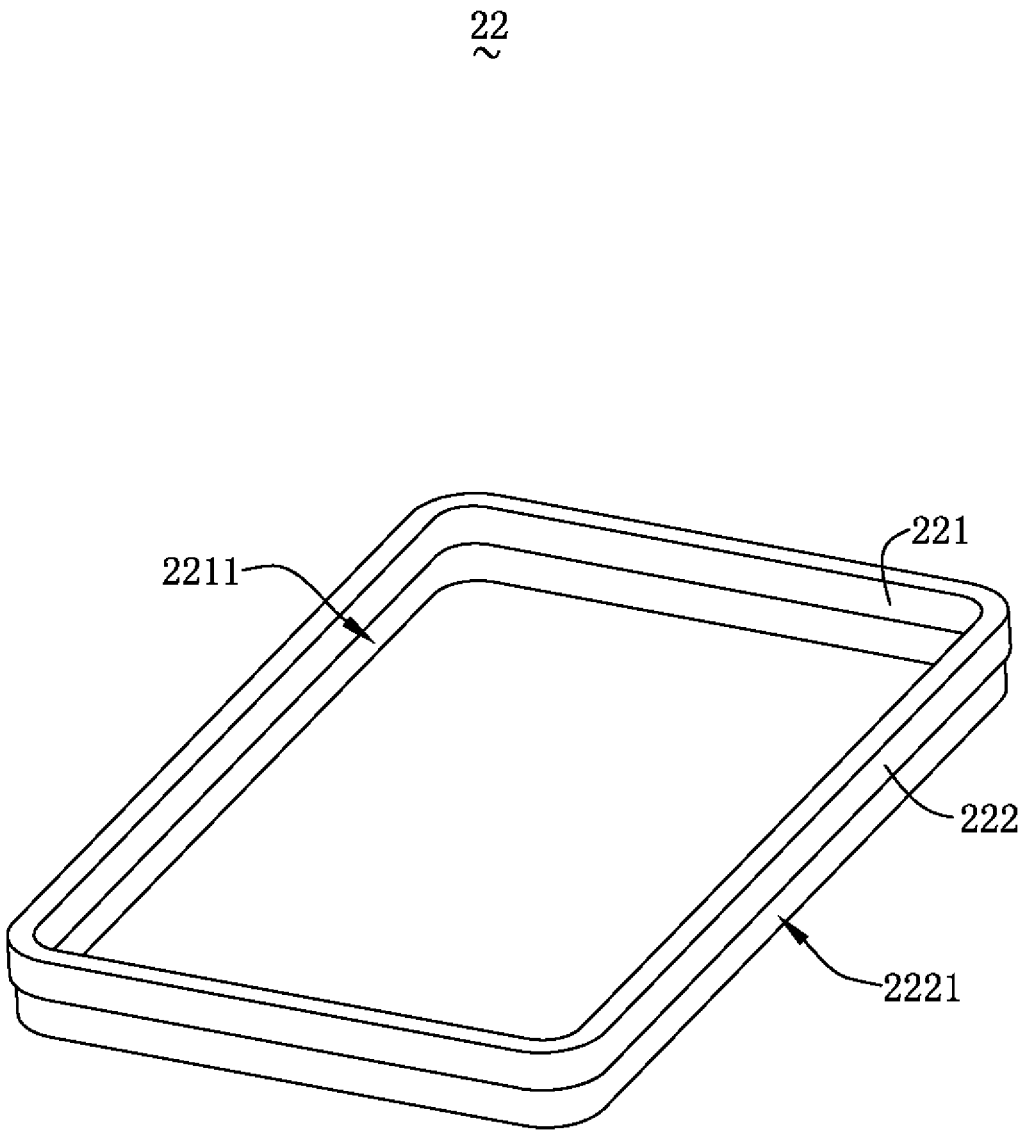
FIG. 3 is a perspective structural schematic diagram of a voice coil shown in FIG. 2.

Referring to FIG. 3 in conjunction, the voice coil 22 includes an inner side-surface 221 close to the magnet 12 and an outer side-surface 222 arranged opposite to the inner side-surface 221.

The inner side-surface 221 is recessed towards the outer side-surface 222 to form a first recess 2211, and the outer side-surface 222 is recessed towards the inner side-surface 221 to form a second recess 2221. Specifically, the first recess 2211 and the second recess 2221 are provided to be symmetrical, and the first recess 2211 and the second recess 2221 are both located on a side of the voice coil 22 facing away from the diaphragm 21.

Figure 4:
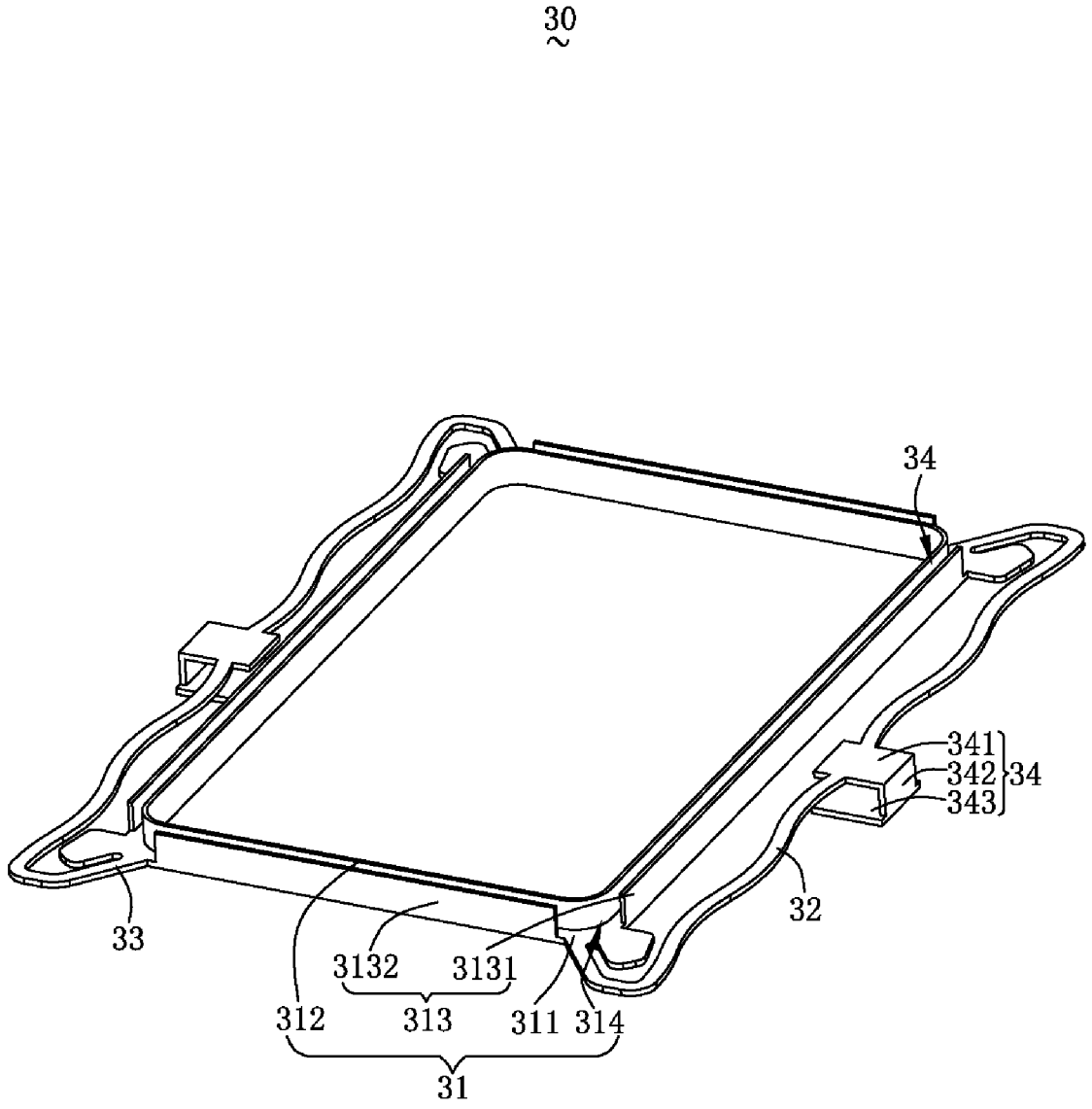
FIG. 4 is a perspective structural schematic diagram of an electrical connection member shown in FIG. 2.
Figure 5:
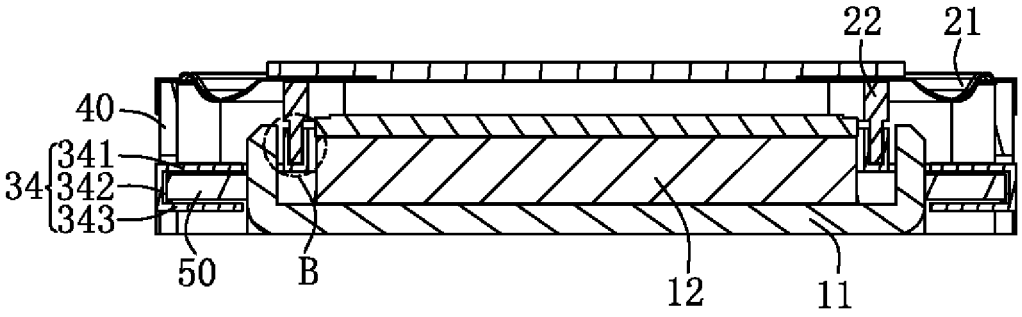
FIG. 5 is a cross-sectional diagram taken along line A-A of FIG. 1.
Figure 6:
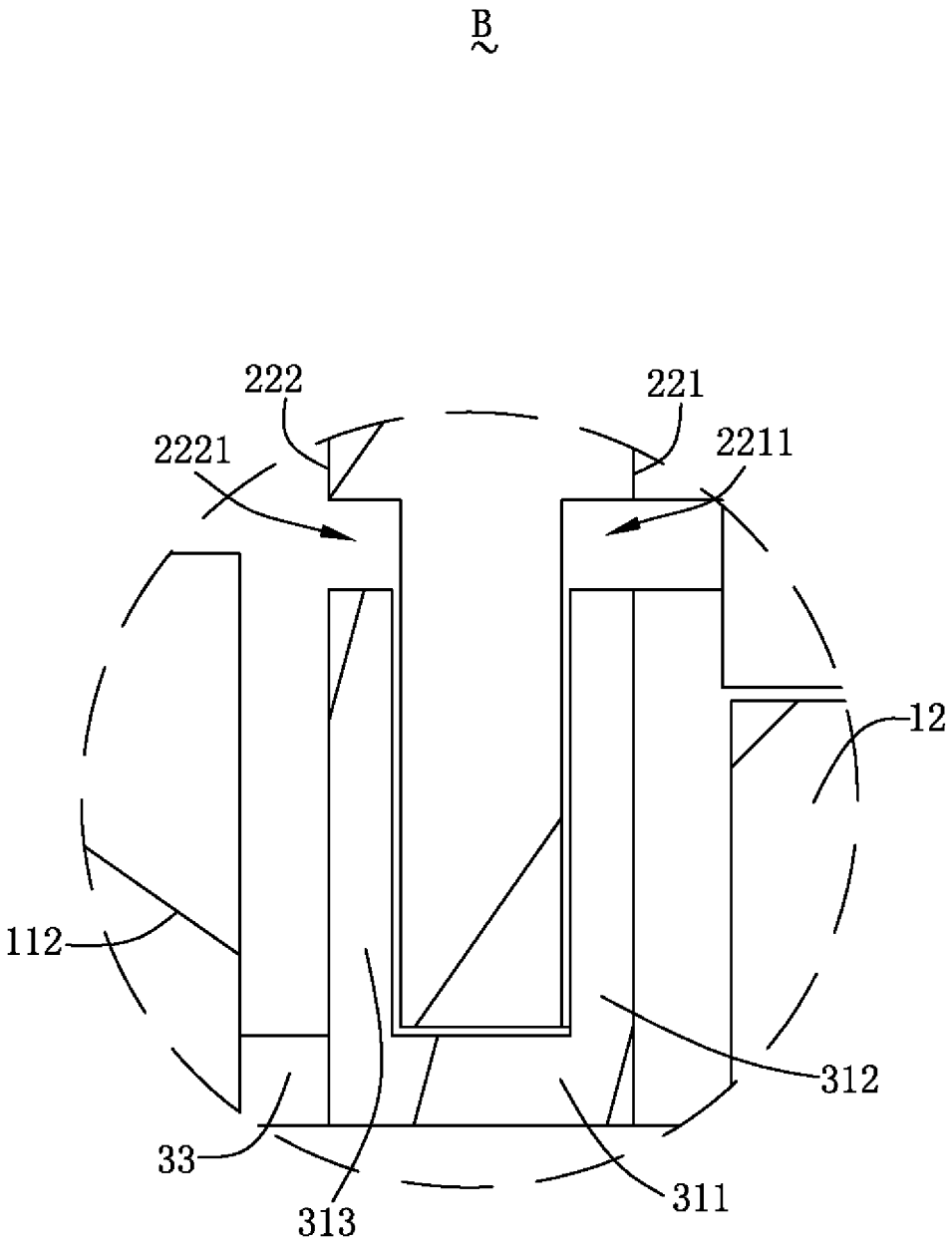
FIG. 6 is an enlarged partial structural diagram of a region B shown in FIG. 5.

Referring to FIG. 4 to FIG. 6 in conjunction, the electrical connection member 30 is connected to the voice coil 22 and elastically supports the voice coil 22.

The electrical connection member 30 includes a support portion 31 that supports one end of the voice coil 22 facing away from the diaphragm 21, an elastic arm 32 that is spaced apart from the support portion 31, a joint portion 33 formed by the elastic arm 32 extending respectively along two opposite ends on one side of the voice coil 22 towards the support portion 31, and a pad 34 formed on the elastic arm 32. The outer side-surface 222 is located at a side close to the elastic arm 32.

The support portion 31 includes a body portion 311 facing right towards the diaphragm 21 and a first extension arm 312 and a second extension arm 313 which respectively extend from the body portion 311 while being bent towards the diaphragm 21. The first extension arm 312 is arranged and fixed opposite to the inner side-surface 221. The second extension arm 313 is arranged and fixed opposite to the outer side-surface 222. The first extension arm 312 is arranged opposite to and spaced apart from the second extension arm 313, and the first extension arm 312 and the second extension arm 313 are symmetrically arranged on two sides of the voice coil 22. The voice coil 22 is sandwiched and fixed between the first extension arm 312 and the second extension arm 313.

The first extension arm 312 is correspondingly provided at the first recess 2211, and the second extension arm 313 is correspondingly provided at the second recess 2221. The first extension arm 312 has a continuous ring shape and is provided around the inner side-surface 221. The second extension arm 313 is provided around the outer side-surface 222 and the two adjacent second extension arms 313 are provided with a notch 314 for avoiding the joint portion 33. Specifically, the second extension arm 313 includes a pair of long sidewalls 3131 arranged opposite to each other and a pair of short sidewalls 3132 arranged opposite to each other. There are four notches 314, and the four notches 314 are respectively located at a position where a long sidewall 3131 and a short sidewall 3132 that are adjacent are connected. In addition, the notch 314 is provided corresponding to the avoiding portion 113. The two long sidewalls 3131, the two short sidewalls 3132 and the four notches 314 together enclose a rectangular ring structure, i.e., a direction in which the long sidewall 3131 is provided and a direction in which the short sidewall 3132 is provided are perpendicular to each other.

It can be understood that by providing the first extension arm 312 and the second extension arm 313 on the electrical connection member 30, the first extension portion 312, the body portion 311 and the second extending arm 313 form a U-shaped receiving space to receive the voice coil 22, which increases the bonding strength between the voice coil 22 and the electrical connection member 30 and enables the connection between the voice coil 22 and the electrical connection member 30 to be more stable when the voice coil 22 vibrates, thereby improving the reliability of the voice coil 22 when the voice coil 22 is in swinging and disconnect during its operation and also increasing the maximum amplitude of the voice coil 22.

There are two elastic arms 32, and the two elastic arms 32 are symmetrically provided about a central axis of the body portion 311 in a length direction thereof. The two elastic arms 32 are respectively apart from and right opposite to the two second sidewalls 1122.

The joint portion 33 connects the support portion 31 and the elastic arm 32 via the avoiding portion 113 and the notch 314.

The pad 34 includes an extension portion 341 extending from the elastic arm 32 in a direction facing away from the receiving space, a connecting portion 342 that is bent and extends from a distal end of the extension portion 341 in a direction facing away from the diaphragm 21, and a conductive portion 343 that is bent and extends from an end of the connecting portion 342 facing away from the extension portion 341. The conductive portion 343 is opposite to the extension portion 341. The frame body 50 is sandwiched between the conductive portion 343 and the extension portion 341.

Compared with the related art, in the speaker provided in the present disclosure, the first extension arm is arranged and fixed opposite to the inner side-surface of the voice coil and the second extension arm is arranged and fixed opposite to the outer side-surface, such that the voice coil is sandwiched and fixed between the first extension arm and the second extension arm, which increases the bonding strength between the voice coil and the electrical connection member, thereby improving the reliability of the voice coil when the voice coil is in swinging and disconnect during its operation and also increasing the maximum amplitude of the voice coil and thus improving the acoustic performance of the speaker.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A speaker, comprising:

a holder having a receiving space;

a vibration unit received in the holder, the vibration unit comprising a diaphragm configured to vibrate and emit sound and a voice coil located at a side of the diaphragm and configured to drive the diaphragm to vibrate and emit sound;

a magnetic circuit unit received in the holder and configured to drive the vibration unit to vibrate and emit sound; and an electrical connection member received in the holder and electrically connected to the vibration unit, the electrical connection member being electrically connected to the voice coil and configured to elastically support the voice coil, wherein the electrical connection member comprises a support portion supporting an end of the voice coil facing away from the diaphragm, an elastic arm arranged spaced apart from the support portion, and a joint portion formed by the elastic arm extending respectively along two opposite ends on one side of the voice coil towards the support portion; the support portion comprises a body portion facing right towards the diaphragm and a first extension arm and a second extension arm which respectively extend from the body portion while being bent towards the diaphragm; the voice coil comprises an outer side-surface close to the elastic arm and an inner side-surface arranged opposite to the outer side-surface; and the first extension arm is arranged and fixed opposite to the inner side-surface, the second extension arm is arranged and fixed opposite to the outer side-surface, and the voice coil is sandwiched and fixed between the first extension arm and the second extension arm.

2. The speaker as described in claim 1, wherein the inner side-surface is recessed towards the outer side-surface to form a first recess corresponding to the first extension arm.

3. The speaker as described in claim 1, wherein the outer side-surface is recessed towards the inner side-surface to form a second recess corresponding to the second extension arm.

4. The speaker as described in claim 2, wherein the outer side-surface is recessed towards the inner side-surface to form a second recess corresponding to the second extension arm.

5. The speaker as described in claim 3, wherein the first extension arm has a continuous ring shape and is provided around the inner side-surface.

6. The speaker as described in claim 4, wherein the first extension arm has a continuous ring shape and is provided around the inner side-surface.

7. The speaker as described in claim 3, wherein the second extension arm is provided around the outer side-surface and a notch is formed between two adjacent second extension arms and configured to avoid the joint portion.

8. The speaker as described in claim 4, wherein the second extension arm is provided around the outer side-surface and a notch is formed between two adjacent second extension arms and configured to avoid the joint portion.

9. The speaker as described in claim 3, wherein the first extension arm is arranged opposite to and spaced apart from the second extension arm.

10. The speaker as described in claim 4, wherein the first extension arm is arranged opposite to and spaced apart from the second extension arm.

11. The speaker as described in claim 1, wherein the electrical connection member further comprises a pad formed on the elastic arm, and the pad extends at least partially out of the holder for electrical connection with outside.

12. The speaker as described in claim 1, wherein the first extension arm and the second extension arm are symmetrically provided on two sides of the voice coil.

13. The speaker as described in claim 7, wherein the speaker further comprises a frame body fixedly provided on an end of the holder close to the electrical connection member, the pad comprises an extension portion extending from the elastic arm in a direction facing away from the receiving space, a connecting portion that is bent and extends from a distal end of the extension portion in a direction facing away from the diaphragm, and a conductive portion that is bent and extends from an end of the connecting portion away from the extension portion, the conductive portion is opposite to the extension portion, and the frame body is sandwiched between the conductive portion and the extension portion.

* * * * *